US007392793B2

(12) United States Patent
Hayakawa

(10) Patent No.: US 7,392,793 B2
(45) Date of Patent: Jul. 1, 2008

(54) FUEL INJECTION CONTROLLER

(75) Inventor: Yoshiki Hayakawa, Kuwana (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/727,074

(22) Filed: Mar. 23, 2007

(65) Prior Publication Data

US 2007/0221174 A1 Sep. 27, 2007

(30) Foreign Application Priority Data

Mar. 27, 2006 (JP) ..... 2006-084661

(51) Int. Cl.
*F02M 59/02* (2006.01)
*F02M 59/36* (2006.01)

(52) U.S. Cl. ..... 123/479; 123/690; 123/447; 123/456

(58) Field of Classification Search ..... 123/479, 123/690, 447, 456
See application file for complete search history.

(56) References Cited

U.S. PATENT DOCUMENTS 4,777,921 A 10/1988 Miyaki et al.
5,937,826 A * 8/1999 Olson et al. ..... 123/447
5,983,863 A * 11/1999 Cavanagh et al. ..... 123/447
6,076,504 A * 6/2000 Stavnheim et al. ..... 123/447
6,095,118 A * 8/2000 Klinger et al. ..... 123/447
6,694,950 B2 * 2/2004 Djordjevic ..... 123/456
6,899,084 B2 * 5/2005 Miyashita ..... 123/446
7,017,554 B2 * 3/2006 Wang ..... 123/447
7,025,050 B2 * 4/2006 Oono et al. ..... 123/690
7,063,073 B2 * 6/2006 Ausiello et al. ..... 123/446
7,272,486 B2 * 9/2007 Speetzen et al. ..... 123/446

* cited by examiner

*Primary Examiner*—Erick Solis
(74) *Attorney, Agent, or Firm*—Nixon & Vanderhye PC

(57) ABSTRACT

A fuel injection controller calculates a fuel pressure-feeding start angle of a fuel pump as a valve opening start angle of a metering valve, which regulates a discharge amount, by adding a base angle and a feedback correction value. The base angle is calculated in accordance with a command injection amount and target fuel pressure based on a basic map. The feedback correction value is calculated based on differential pressure between sensed fuel pressure and the target fuel pressure. If an abnormality is caused in either one of two metering valves, the base angle is calculated based on an abnormal period map instead of the basic map. Thus, controllability of the fuel pressure is maintained high even when the abnormality is caused in a part of multiple pressure-feeding systems including multiple plungers of the fuel pump.

8 Claims, 10 Drawing Sheets

#1
#3
#4
#2
#1
#3
#4
#2
#1
#3
#4
#2
#1
#3
#4
#2
#1
#3
#4
#2
#1
#3
#4
TDC
PUMP
PLUNGER
#1
#2
#1
#2
#1
#2

FUEL INJECTION CONTROLLER

CROSS REFERENCE TO RELATED APPLICATION

This application is based on and incorporates herein by reference Japanese Patent Application No. 2006-84661 filed on Mar. 27, 2006.

BACKGROUND OF THE INVENTION

1. Field of the Invention

The present invention relates to a fuel injection controller applied to a fuel injection device of an internal combustion engine having a pressure accumulation chamber that accumulates fuel in a high-pressure state and that supplies the fuel to injectors, a fuel pump that pressure-feeds the fuel to the pressure accumulation chamber through reciprocating motion of multiple plungers, and a sensor that senses the fuel pressure in the pressure accumulation chamber, the fuel injection controller having a control device that controls the sensed fuel pressure to target fuel pressure by operating the fuel pump.

2. Description of Related Art

A known fuel injection device of this kind has a common pressure accumulation chamber (common rail) for supplying high-pressure fuel to injectors of respective cylinders of a diesel engine, for example, as described in JP-A-S62-258160. The common rail diesel engine can freely set a target value of the fuel pressure (target fuel pressure) in the common rail in accordance with an operation state of the engine and can freely control the fuel pressure supplied to the injectors.

A fuel injection controller performs open control of deciding an operation amount of a fuel pump based on the operation state of the engine or feedback control of deciding the operation amount of the fuel pump based on a difference between the fuel pressure in the common rail sensed by a fuel pressure sensor and the target fuel pressure to make the fuel pressure in the common rail follow the target fuel pressure.

However, controllability of the fuel pressure is deteriorated if an abnormality is caused in either one of multiple pressure-feeding systems that pressure-feed the fuel to the common rail with multiple plungers of the fuel pump respectively. The fuel injection controller performing only the open control sets the operation amount of the fuel pump on an assumption that all the pressure-feeding systems are normal. Accordingly, a fuel amount pressure-fed to the common rail falls short and the fuel pressure decreases when the abnormality is caused. As for the fuel injection controller performing the feedback control, the controllability of the fuel pressure is deteriorated due to a response delay in the feedback control immediately after the abnormality is caused. As for the fuel injection controller that performs both of the open control and the feedback control to improve the following performance of the fuel pressure to follow the target fuel pressure and control stability during a transitional period, the open control for improving the following performance during the transitional period cannot function normally because of the abnormality in the pressure-feeding system. As a result, the controllability is deteriorated.

SUMMARY OF THE INVENTION

It is an object of the present invention to provide a fuel injection controller of a fuel injection device having a fuel pump, which includes multiple plungers constituting multiple pressure-feeding systems respectively, the fuel injection controller being capable of maintaining high controllability of fuel pressure even when an abnormality is caused in a part of the pressure-feeding systems.

According to an aspect of the present invention, a fuel injection controller has a control device and an increasing device. The control device controls sensed fuel pressure to target fuel pressure by operating a fuel pump. The increasing device increases a pressure-feeding amount of a part of pressure-feeding systems that does not correspond to an abnormality by compulsorily changing an operation amount of the fuel pump, which is decided by the control device, based on abnormality information about the other part of the pressure-feeding systems.

The above-described structure compulsorily changes the operation amount of the fuel pump based on the abnormality information. Accordingly, even in the case where the control device does not have a function of performing feedback control, the sensed fuel pressure can be conformed to the target fuel pressure regardless of the abnormality in the pressure-feeding system. In the case where the control device has the feedback control function, following performance of the fuel pressure to follow the target fuel pressure can be improved compared to the feedback control that compensates a deviation of the sensed fuel pressure from the target fuel pressure.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENTS

Figure 1:
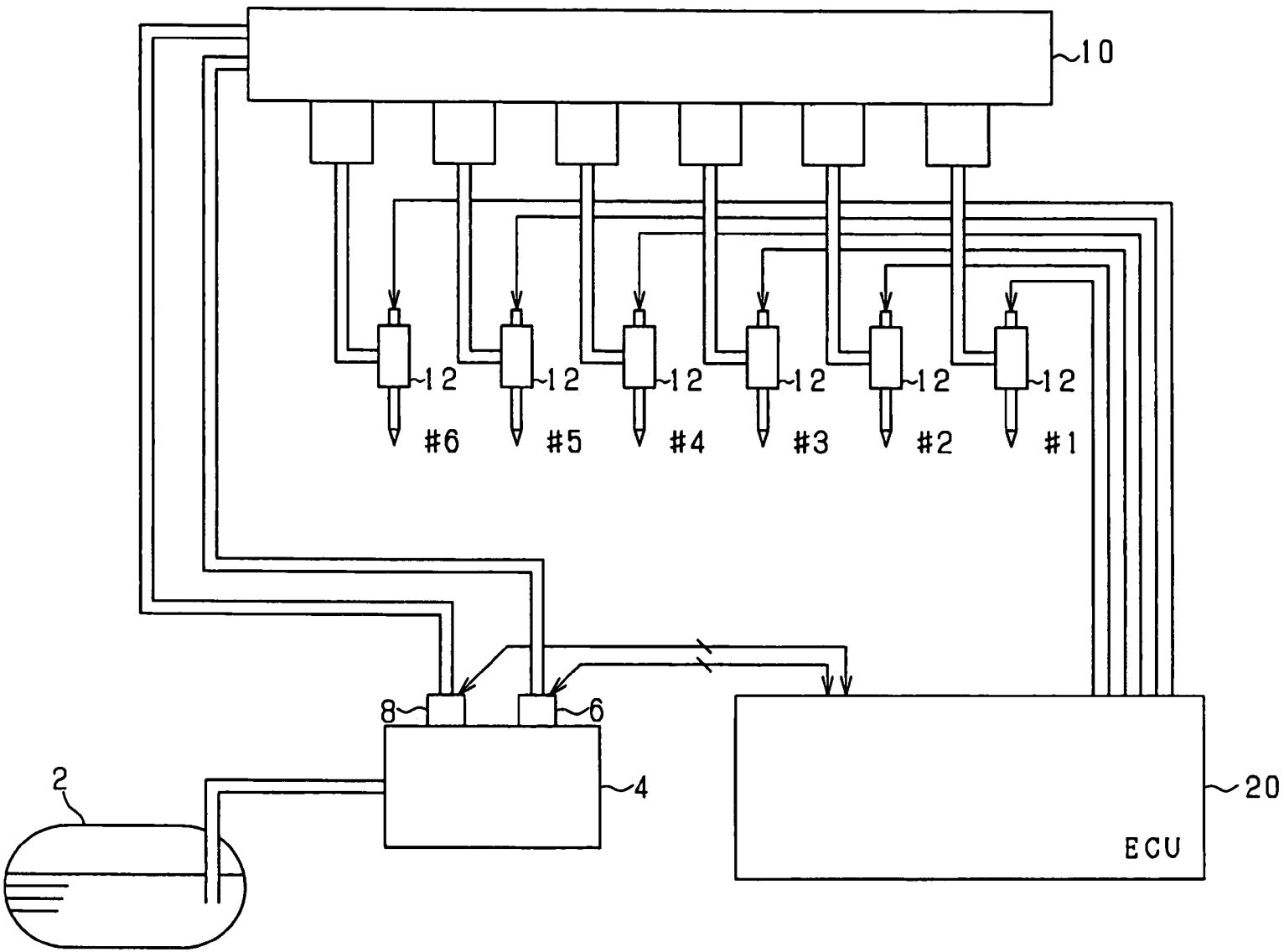
FIG. 1 is a diagram showing an engine system according to a first embodiment of the present invention.

Referring to FIG. 1, an engine system according to a first embodiment of the present invention is illustrated. In the present embodiment, a fuel injection controller according to the present invention is applied to a fuel injection controller of a common rail diesel engine as an internal combustion engine. A fuel pump 4 draws fuel stored in a fuel tank 2. The fuel pump 4 has first and second plungers (not shown) and has a first metering valve 6 and a second metering valve 8 corresponding to the first and second plungers. The first and second metering valves 6, 8 are discharge amount metering valves for regulating an amount of discharged fuel out of the fuel drawn from the fuel tank 2. In order to discharge the fuel from the fuel pump 4, the first metering valve 6 or the second metering valve 8 is closed during a period in which the first or second plunger moves from a bottom dead center toward a top dead center while the first or second plunger reciprocates between the top dead center and the bottom dead center. The fuel discharged from the fuel pump 4 is pressure-fed to a common rail 10, which supplies the fuel to injectors 12 of respective cylinders (six cylinders in the present embodiment).

Figure 2:
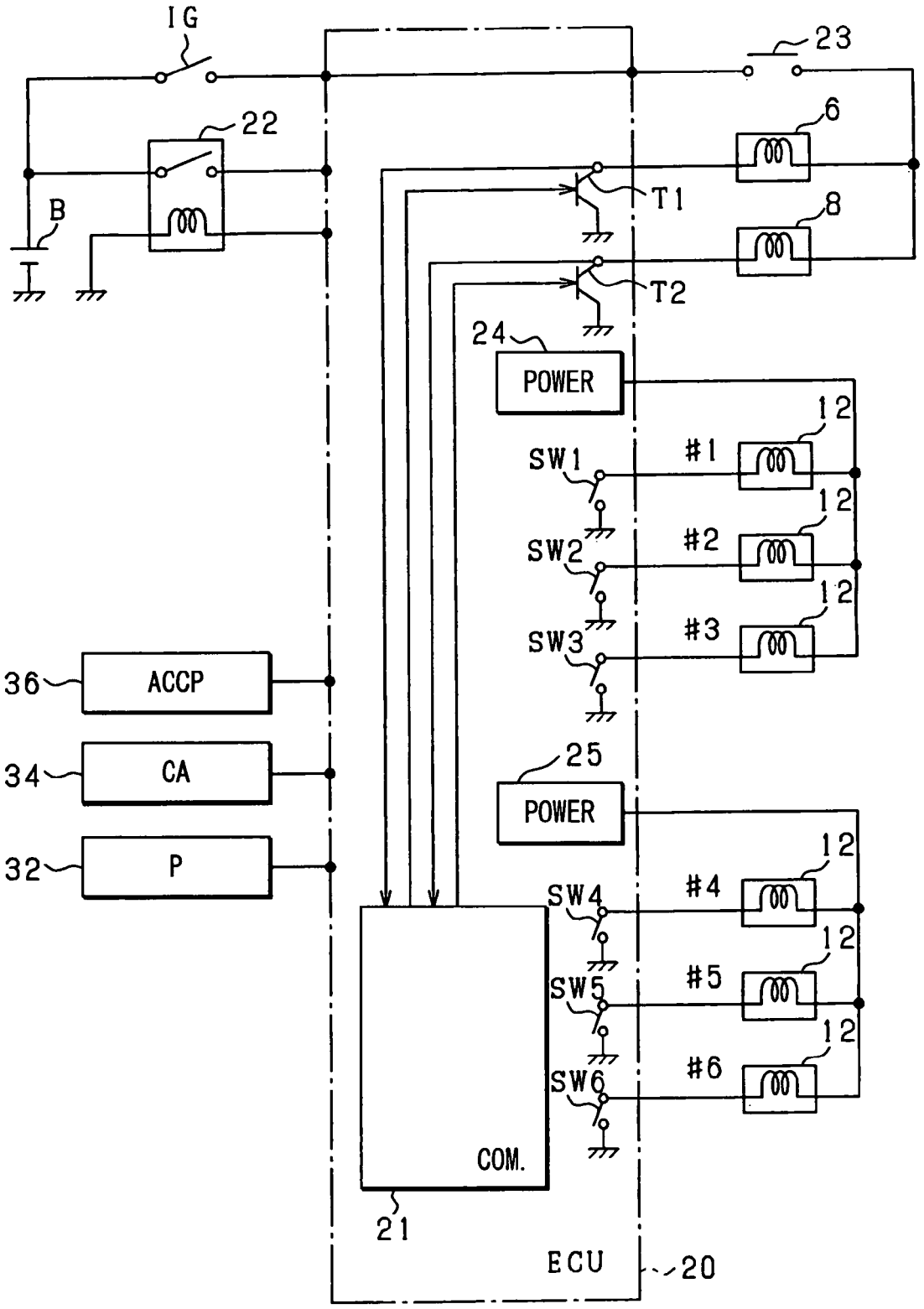
FIG. 2 is a diagram showing an ECU and components electrically connected with the ECU according to the first embodiment.

An electronic control unit 20 (ECU) controls an output of the engine by operating actuators of the engine such as the first metering valve 6, the second metering valve 8 and the injectors 12. FIG. 2 shows structure of the ECU 20 and components in electric communication with the ECU 20. As shown in FIG. 2, the ECU 20 generally includes a microcomputer 21. A power can be supplied to the ECU 20 from a battery B through an ignition switch IG. The power can be supplied to the ECU 20 also through a main relay 22. The main relay 22 is provided for maintaining the power supply from the battery B while after processing to be performed after the ignition switch IG is turned off is performed in the ECU 20 after the ignition switch IG is turned off, for example.

The power of the battery B is applied to one of terminals of the first metering valve 6 and to one of terminals of the second metering valve 8 through a relay 23. The other terminal of the first metering valve 6 and the other terminal of the second metering valve 8 are grounded through collectors and emitters of transistors T1, T2 respectively. Drive current is outputted to bases of the transistors T1, T2 from the microcomputer 21. Thus, the first metering valve 6 and the second metering valve 8 are driven.

The ECU 20 has power source circuits 24, 25, each of which includes a voltage booster circuit for boosting the voltage of the battery B and a constant current circuit for causing constant current to flow. The power source circuit 24 supplies the power to the injectors 12 of the first to third cylinders #1-#3. The power source circuit 25 supplies the power to the injectors 12 of the fourth to sixth cylinders #4-#6. The ECU 20 has switching elements SW1-SW6 for providing and breaking the conduction between the injectors 12 and the ground. The power source circuit 24, the injectors 12 and the switching elements SW1-SW3 provide a power supply route of the injectors 12 of the first to third cylinders #1-#3. The power source circuit 25, the injectors 12 and the switching elements SW4-SW6 provide a power supply route of the injectors 12 of the fourth to sixth cylinders #4-#6.

The ECU 20 reads sensing values of sensors for sensing operation states of the engine such as a fuel pressure sensor 32 for sensing the fuel pressure P in the common rail 10 and a crank angle sensor 34 for sensing a rotation angle CA of a crankshaft of the engine. The ECU 20 takes in a sensing value of an accelerator sensor 36 for sensing an operation amount ACCP of an accelerator pedal.

Figure 3:
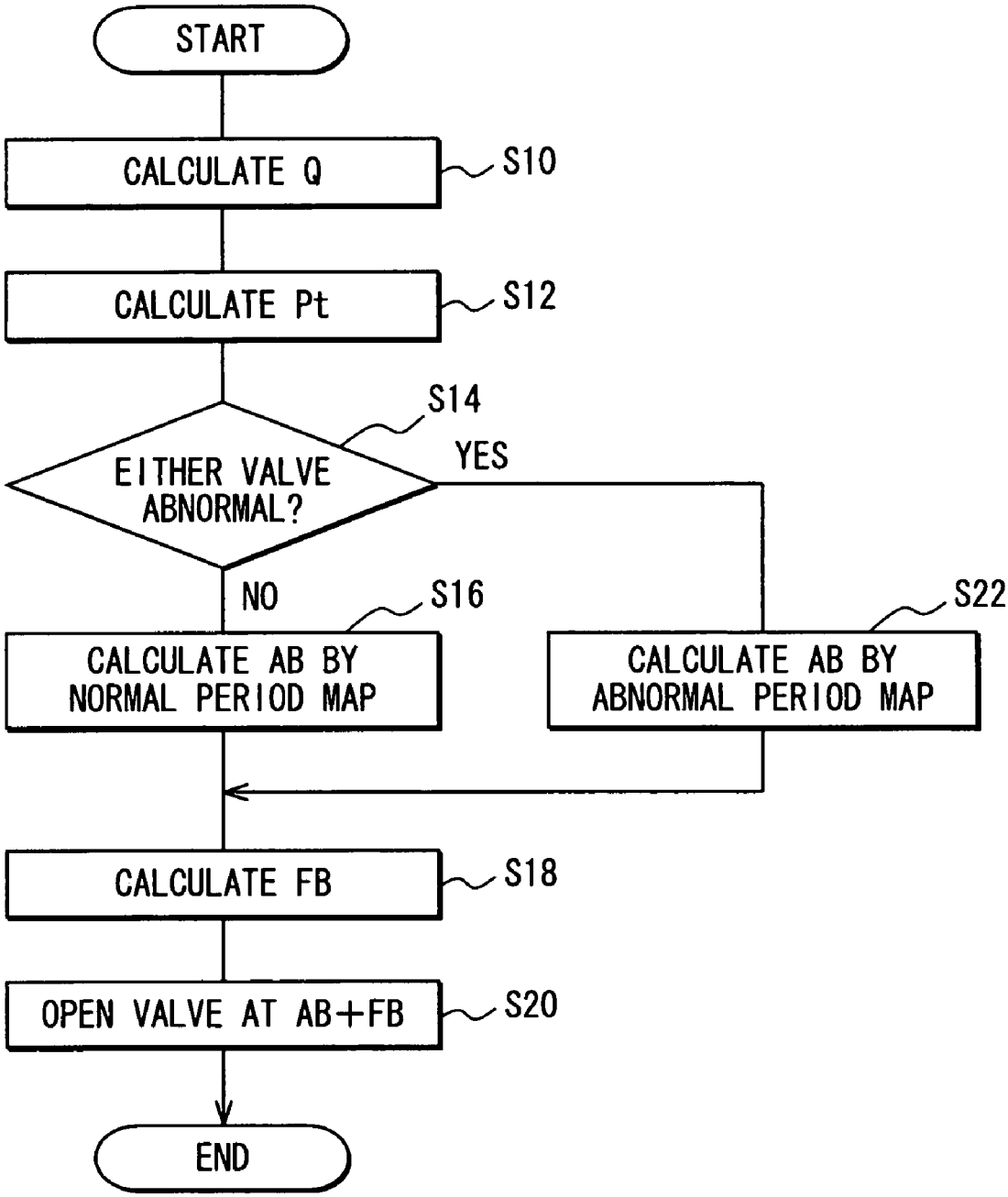
FIG. 3 is a flowchart showing processing steps of fuel pressure control according to the first embodiment.

The ECU 20 controls the output of the engine based on the sensing values of the sensors. The ECU 20 performs feedback control of conforming the fuel pressure P in the common rail 10 to a target value (target fuel pressure Pt) to suitably perform the output control of the engine. FIG. 3 shows processing steps of the feedback control of the fuel pressure P. The ECU 20 repeatedly performs the processing shown in FIG. 3, for example, in a predetermined cycle.

In a series of the processing shown in FIG. 3, first, Step S10 calculates a command value of an injection amount (command injection amount Q) of the injector 12 based on the operation amount ACCP of the accelerator pedal sensed by the accelerator sensor 36 and rotation speed of the crankshaft based on the sensing value of the crank angle sensor 34. Following Step S12 calculates the target fuel pressure Pt based on the command injection amount Q and the rotation speed.

Step S14 determines whether there is an abnormality in the first metering valve 6 or the second metering valve 8. The determination is performed based on whether the current flows through the collector and the emitter of each one of the transistors T1, T2. If the current flows through the collector and the emitter of the transistor T1 or the transistor T2, it can be determined that the current flows through the first metering valve 6 or the second metering valve 8 and it can be determined that the first metering valve 6 or the second metering valve 8 is operating normally.

Figure 4A:
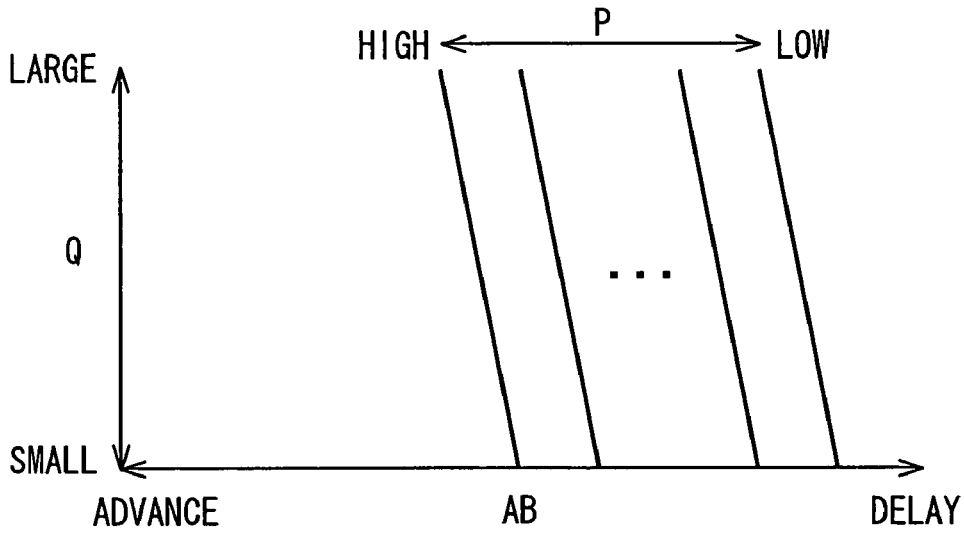
FIG. 4A is a diagram showing a map for deciding a pressure-feeding start angle according to the first embodiment.

If Step S14 determines that there is no abnormality in the first and second metering valves 6, 8 (Step S14: NO), the process goes to Step S16. Step S16 performs map calculation of a base value AB (base angle) of a fuel pressure-feeding start angle, i.e., a crank angle CA for starting the fuel discharge with the fuel pump 4, based on a map (normal period map, basic map) shown in FIG. 4A. The map shown in FIG. 4A is for determining the appropriate pressure-feeding start crank angle for conforming the fuel pressure P to the target fuel pressure Pt on an assumption that the fuel pump 4, the common rail 10, the injectors 12 and the like have standard characteristics. The standard characteristics should be preferably median characteristics, i.e., average characteristics provided when mass production of the common rail 10, the fuel pump 4 and the injectors 12 is implemented.

The map shown in FIG. 4A decides the relationship among the command injection amount Q, the target fuel pressure Pt and the pressure-feeding start angle. As shown in FIG. 4A, the pressure-feeding start angle is advanced as the command injection amount Q increases. This corresponds to that the required discharge amount of the fuel pump 4 increases as the command injection amount Q increases. The pressure-feeding start angle is advanced as the fuel pressure P increases. It is because, for example, the fuel amount leaking from the common rail 10 into the fuel tank 2 through the injectors 12 without being injected by the injectors 12 increases as the fuel pressure P increases. No leak passage is shown in FIG. 1 for the sake of simplicity.

If the base angle AB is calculated, Step S18 calculates a feedback correction value FB through PID control based on the differential pressure between the fuel pressure P in the common rail 10 sensed by the fuel pressure sensor 32 and the target fuel pressure Pt.

Following Step S20 performs opening operation of the first metering valve 6 or the second metering valve 8 at the pressure-feeding start angle calculated by adding the base angle AB and the correction value FB.

Figure 5:
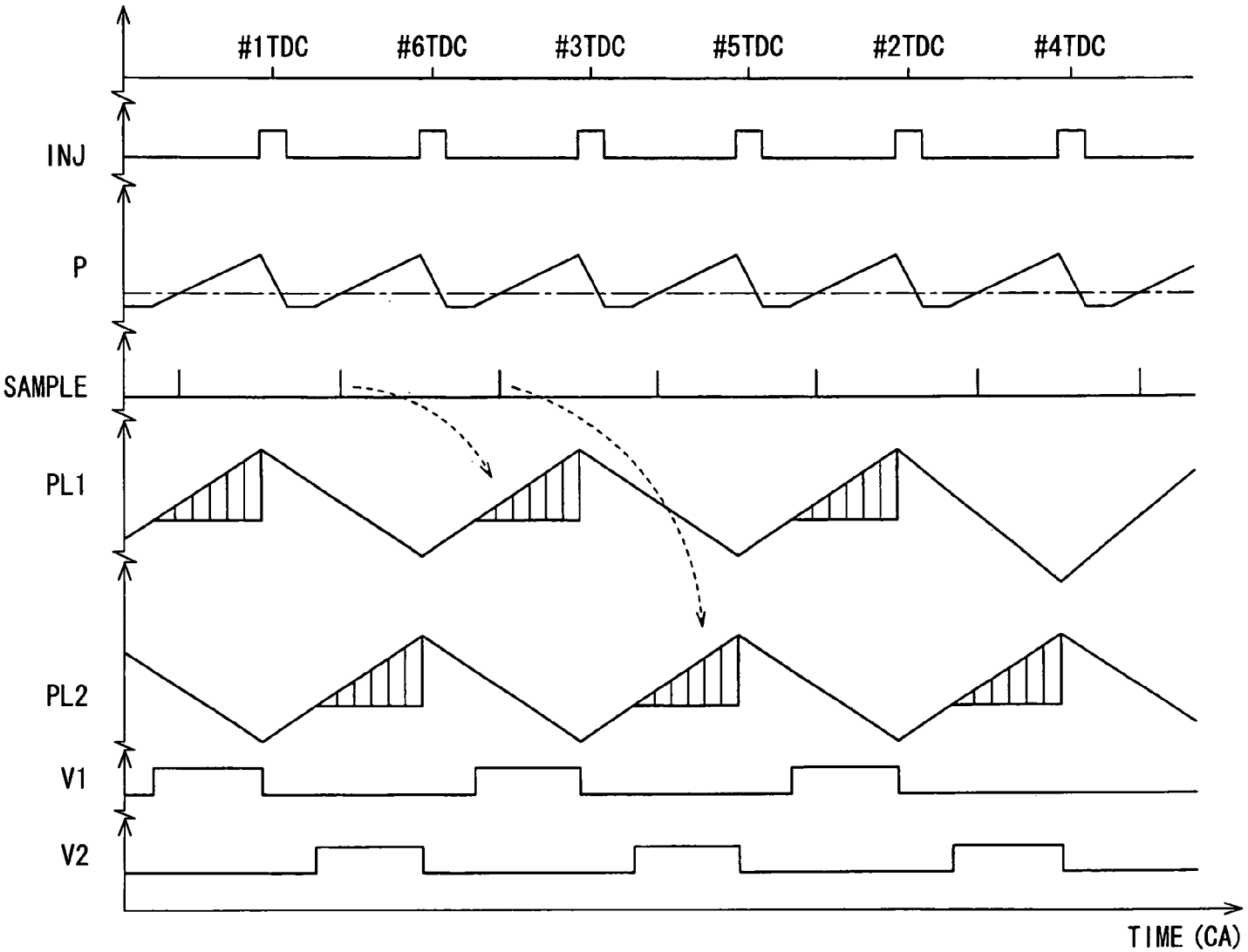
FIG. 5 is a time chart showing a control mode during a normal period according to the first embodiment.

FIG. 5 shows a control mode of the fuel pressure P achieved by the above-described processing. In FIG. 5, INJ represents a fuel injection period, P is a behavior of the fuel pressure P in the common rail 10, SAMPLE is sampling timing used in the calculation in the feedback control but of the sampling timing of the output of the fuel pressure sensor 32, PL1 is a transition of a displacement mode of the first plunger, PL2 is a transition of a displacement mode of the second plunger, V1 is a transition of an operation mode of the first metering valve 6, and V2 is a transition of the operation mode of the second metering valve 8. In FIG. 5, #1TDC-#6TDC represent top dead centers of the first to sixth cylinders #1-#6 respectively. Each shaded area in FIG. 5 represents discharge operation of the first or second plunger.

As shown in FIG. 5, the system according to the present embodiment is a synchronous system providing a one-to-one correspondence between the fuel injection and the pressure-feeding. The first metering valve 6 performs the pressure-feeding immediately before the fuel injection performed by the injector 12 of the first group, and the second metering valve 8 performs the pressure-feeding immediately before the fuel injection performed by the injector 12 of the second group.

In FIG. 5, the amount of the fuel pressure-fed between the fuel injections corresponds to the fuel injection amount of the single fuel injection. Thus, the fuel flowing out of the common rail 10 due to the fuel injection and the like and the fuel pressure-fed to the common rail 10 are in a stationary equilibrium state. Accordingly, the fuel pressure P as of the fuel injection can be set at desired fuel pressure. When the stationary equilibrium state is realized as shown in FIG. 5, the sensed fuel pressure P coincides with the target fuel pressure Pt at the sampling timing. In the stationary state, the pressure-feeding start angle is decided by the map shown in FIG. 4A and the feedback correction value FB is zero if the fuel pump 4, the common rail 10 and the injectors 12 have the standard characteristics. If the actual characteristics deviate from the standard characteristics, the deviation in the characteristics is compensated by an integral term in the stationary state.

Figure 4B:
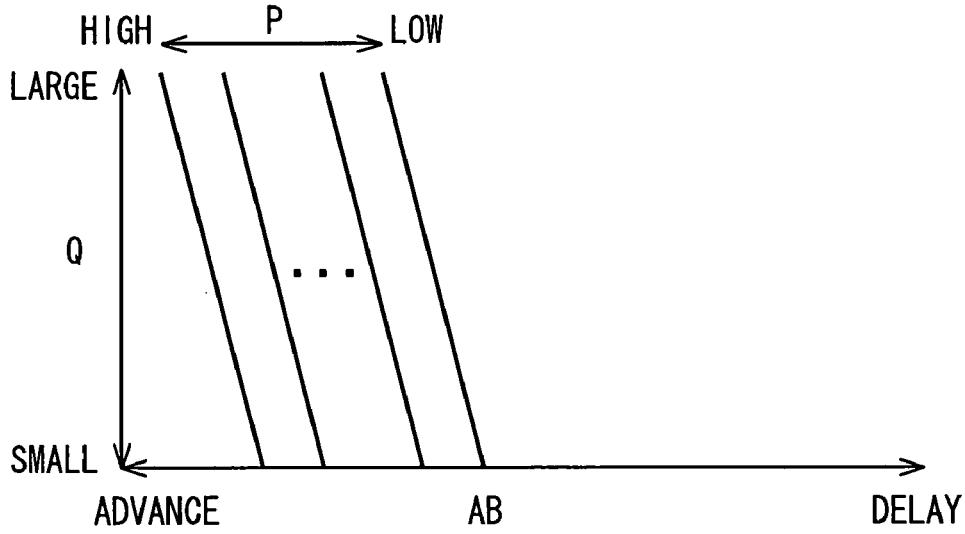
FIG. 4B is a diagram showing another map for deciding the pressure-feeding start angle according to the first embodiment.

If Step S14 shown in FIG. 3 determines that there is an abnormality in either one of the first metering valve 6 and the second metering valve 8, the process goes to Step S22. Step S22 calculates the base angle AB of the pressure-feeding start angle by using a map for the abnormal period shown in FIG. 4B. The abnormal period map shown in FIG. 4B is for setting the pressure-feeding start angle assumed to be able to conform the fuel pressure P in the common rail 10 to the target fuel pressure Pt by pressure-feeding the fuel to the common rail 10 with only one out of the first metering valve 6 and the second metering valve 8. The map shown in FIG. 4B also decides the relationship among the command injection amount Q, the fuel pressure P and the pressure-feeding start angle on an assumption that the fuel pump 4, the common rail 10 and the injectors 12 have the standard characteristics like the normal period map shown in FIG. 4A. The abnormal period map shown in FIG. 4B sets the pressure-feeding start angle to the advanced side compared to the map shown in FIG. 4A for the same command injection amount Q and fuel pressure P. If the processing of Step S22 is completed, the process goes to Step S18 shown in FIG. 3.

Figure 6:
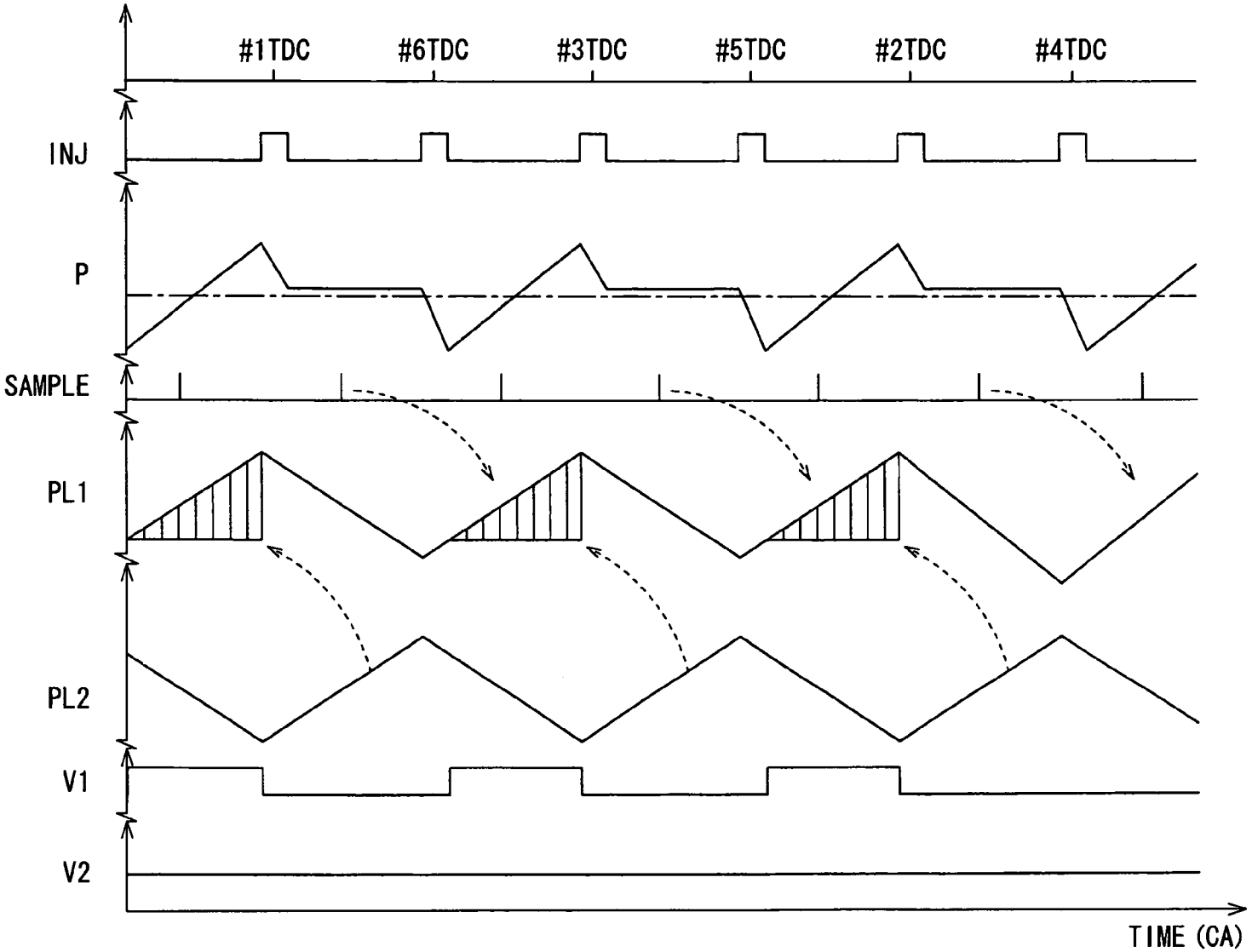
FIG. 6 is a time chart showing a control mode during an abnormal period according to the first embodiment.

FIG. 6 shows a control mode of the fuel pressure P in the case where the abnormality is generated in the second metering valve 8 and the base angle AB of the pressure-feeding start angle is set at Step S22. In this case, the fuel is pressure-fed to the common rail 10 by using only the first metering valve 6 and the first plunger as shown in FIG. 6. Therefore, the pressure-feeding start angle of the first metering valve 6 is changed to the advanced side compared to the case shown in FIG. 5, so the fuel amount metered by the first metering valve 6 increases. The consumption of the fuel in the common rail 10 through two fuel injections is compensated by one fuel pressure-feeding.

Such the state can be realized by correcting the base angle AB with the feedback correction value FB calculated at Step S18 even in the case where Step S16 shown in FIG. 3 calculates the base angle AB. However, in this case, realization of the stationary state of the equilibrium state between the fuel flowing out of the common rail 10 and the fuel flowing into the common rail 10 during the abnormal period takes a long time. Moreover, the base angle AB calculated at Step S16 does not become the appropriate value also during a transitional period in which the target fuel pressure Pt is changed. Therefore, the realization of the stationary state through compensation of the difference between the base angle AB calculated at Step S16 and the required angle with the integral term of the feedback control takes a long time.

In contrast, the controller according to the present embodiment uses the map for the abnormal period at Step S22. Accordingly, the appropriate feedforward control can be performed also during the abnormal period. As a result, the stationary state can be realized quickly even during the transitional period. In this case, the feedback correction value FB is an amount for compensating for the deviation from the standard characteristics and hardly changes even during the transitional period.

The present embodiment exerts following effects.

(1) The pressure-feeding start angle of the fuel pump 4 decided in accordance with the processing at Step S16 is compulsorily changed when it is determined that there is an abnormality in one of the fuel pressure-feeding systems including the two plungers. Thus, the pressure-feeding amount of the pressure-feeding system that does not correspond to the abnormality is increased. Thus, the following performance of the fuel pressure to follow the target fuel pressure can be improved compared to the feedback control that compensates the deviation of the sensed fuel pressure from the target fuel pressure.

(2) The controller has the basic map shown in FIG. 4A for deciding the relationship between the operation amount of the fuel pump 4 and the operation state of the engine at the time when the pressure-feeding systems are normal. The fuel pump 4 is operated in accordance with the base angle AB of the pressure-feeding start decided based on the basic map. By the feedforward control using the basic map, the following performance of the fuel pressure during the transitional period can be improved in the case where the pressure systems are normal.

(3) The controller has the abnormal period map shown in FIG. 4B for deciding the relationship between the pressure-feeding start angle required to control the fuel pressure to the target fuel pressure with only one of the pressure-feeding systems and the operation state of the engine. Thus, even in the case where the abnormality is caused in one of the pressure-feeding systems, the appropriate feedforward control can be performed. As a result, the following performance of the fuel pressure during the transitional period can be improved.

(4) The existence or nonexistence of the abnormality in the pressure-feeding system can be diagnosed appropriately based on the defect in electric conduction of the first metering valve 6 or the second metering valve 8.

Figure 7:
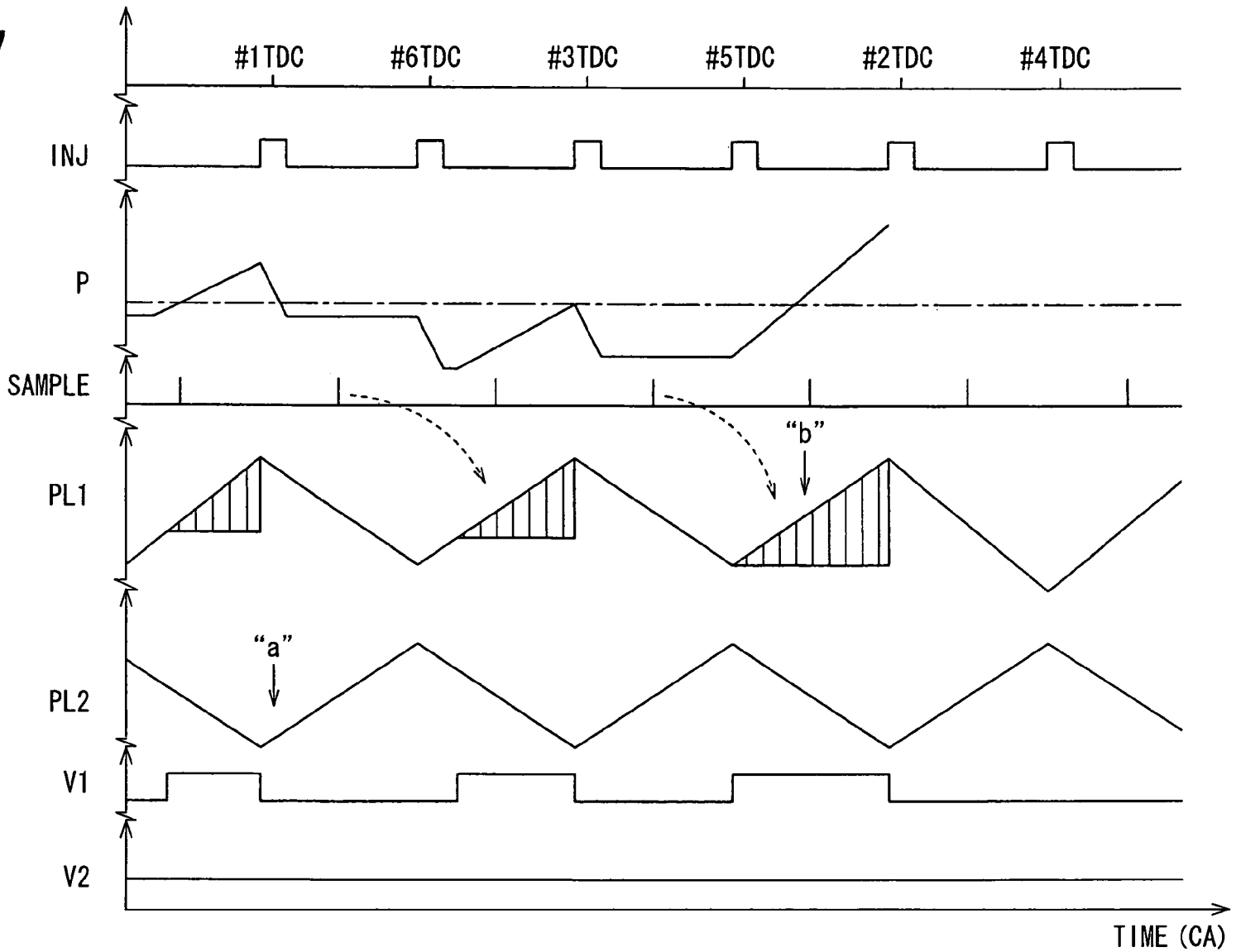
FIG. 7 is a time chart showing a problem of the control according to the first embodiment.

Next, a fuel injection controller according to a second embodiment of the present invention will be explained. The controller according to the first embodiment switches to the abnormal period map shown in FIG. 4B if the abnormality is caused in the first metering valve 6 or the second metering valve 8. However, in this case, there is a possibility that the fuel pressure-feeding amount becomes excessive because the summation of the feedforward term based on the abnormal period map and the feedback correction value FB is changed to the excessively advanced side immediately after the abnormality occurs, depending on the setting of the control. FIG. 7 shows such a situation.

FIG. 7 shows the situation that the pressure-feeding start angle of the first metering valve 6 is not set based on the abnormal period map but is set based on the basic map immediately after the abnormality occurs in the second metering valve 8 at timing "a." In this case, the fuel pressure-feeding amount provided by the first metering valve 6 immediately after the abnormality occurs in the second metering valve 8 is not so different from the pressure-feeding amount provided before the abnormality occurs. The differential pressure is caused between the sensed fuel pressure P and the target fuel pressure Pt at the sampling timing because the second metering valve 8 does not perform the pressure-feeding, so the feedback correction value FB changes. Therefore, the pressure-feeding amount increases by the change amount in the feedback correction value FB compared to the pressure-feeding amount provided before the abnormality occurs.

Therefore, the pressure-feeding amount falls short even with the first pressure-feeding performed by the first metering valve 6 immediately after the abnormality occurs. After that, the second metering valve 8 does not resume the pressure-feeding. As a result, the feedback correction value FB changes largely. If the map is switched at timing "b" and the pressure-feeding start angle of the first metering valve 6 is decided based on the abnormal period map under such the situation, the increase due to the change in the feedback correction value FB is added, in addition to the increase in the pressure-feeding amount due to the switching to the abnormal period map. As a result, the fuel pressure P overshoots as shown in FIG. 7.

Figure 8:
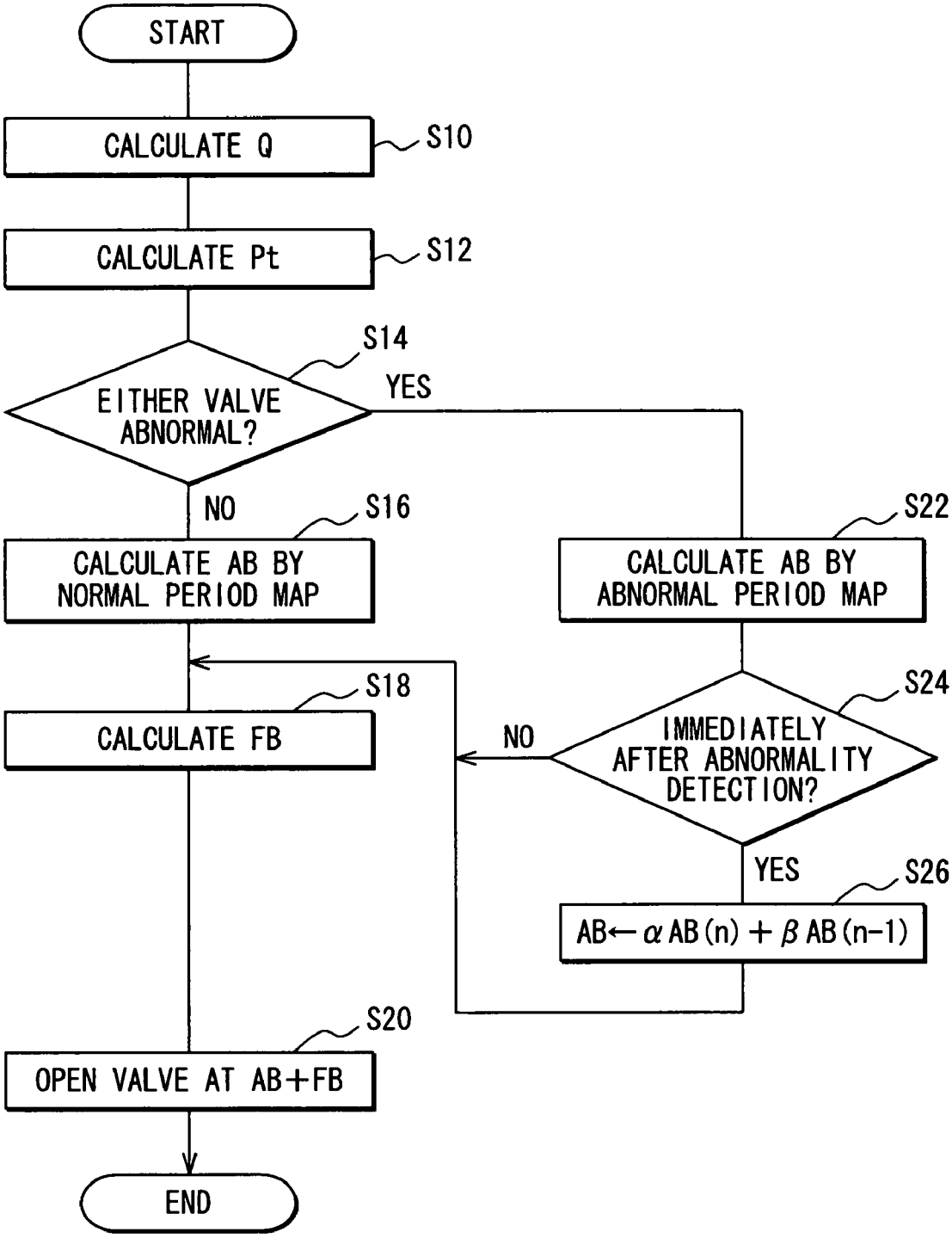
FIG. 8 is a flowchart showing processing steps of fuel pressure control according to a second embodiment of the present invention.

Therefore, the controller according to the present embodiment performs processing for smoothing the change of the base angle AB of the pressure-feeding start angle caused by the map when it is determined that an abnormality is caused in either one of the first metering valve 6 and the second metering valve 8 and the map is switched. FIG. 8 shows processing steps of the feedback control of the fuel pressure according to the present embodiment. The ECU 20 repeatedly performs the processing shown in FIG. 8, for example, in a predetermined cycle.

Next, the processing shown in FIG. 8 will be explained, focusing on a difference between the processing shown in FIG. 8 and the processing shown in FIG. 3. In a series of the processing, if Step S22 calculates the base angle AB based on the abnormal period map, the process goes to Step S24. Step S24 determines whether the present time is immediately after it is determined that there exists an abnormality. For example, it may be determined that the present time is immediately after the determination of the existence of the abnormality if the time number of performing the processing shown in FIG. 8 after the determination of the existence of the abnormality is equal to or less than a predetermined number. If Step S24 is YES, the process goes to Step S26.

Step S26 performs the processing for smoothing the change of the base angle AB. For example, the change of the base angle AB may be smoothed by weighted average processing of multiplying the present base angle AB(n) calculated through the present map calculation and the previous base angle AB(n−1) calculated through the previous map calculation by weights $\alpha$, $\beta$ ($\alpha+\beta=1$) respectively and of adding the products ($AB=\alpha AB(n)+\beta AB(n-1)$). If Step S24 is NO or the processing at Step S26 is completed, the process goes to Step S18.

The present embodiment can exert a following effect in addition to the effects (1) to (4) of the first embodiment.

(5) The processing for smoothing the change of the base angle calculated through the map calculation is performed when the map is switched to the abnormal period map. Thus, when it is determined that the abnormality occurs and the map is switched to the abnormal period map, the excessive increase in the pressure-feeding amount can be inhibited.

Figure 9:
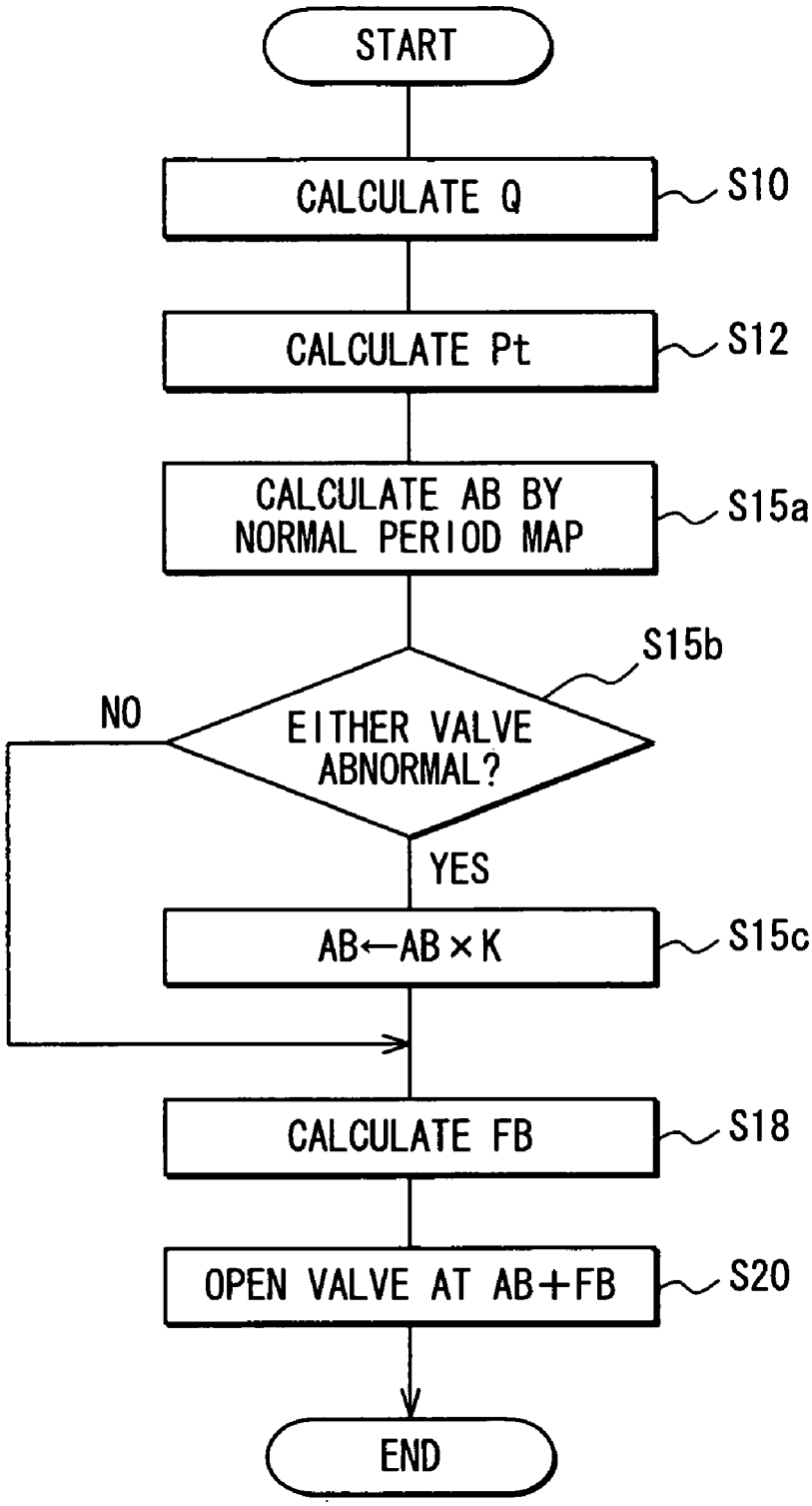
FIG. 9 is a flowchart showing processing steps of fuel pressure control according to a third embodiment of the present invention.

Next, a fuel injection controller according to a third embodiment of the present invention will be explained. The controller according to the present embodiment corrects the base angle AB calculated from the basic map of the normal period (normal period map) instead of preparing the separate abnormal period map. FIG. 9 shows processing steps of the feedback control of the fuel pressure P according to the present embodiment. The ECU 20 repeatedly performs the processing shown in FIG. 9, for example, in a predetermined cycle.

Next, the processing shown in FIG. 9 will be explained, focusing on a difference between the processing shown in FIG. 9 and the processing shown in FIG. 3. As shown in FIG. 9, if the processing of Step S12 is completed, Step S15*a* performs the processing of Step S16 shown in FIG. 3. That is, Step S15*a* calculates the base angle AB by the map shown in FIG. 4A regardless of whether the first metering valve 6 or the second metering valve 8 is normal or abnormal.

If the processing of Step S15*a* is completed, Step S15*b* performs the processing of Step S14 shown in FIG. 3. If Step S15*b* determines that there is an abnormality in either one of the first and second metering valves 6, 8, Step S15*c* corrects the base angle AB to the advanced side. For example, Step S15*c* may multiply the base angle AB by a correction coefficient K. Thus, Step S15*c* corrects the base angle AB to a pressure-feeding start angle assumed to be able to conform the fuel pressure P to the target fuel pressure Pt with only one out of the first metering valve 6 and the second metering valve 8. If the processing of Step S15*c* is completed or Step S15*b* is NO, the process goes to Step S18.

The present embodiment can exert a following effect in addition to the effects (1) to (4) of the first embodiment.

(6) The base angle AB decided by the basic map shown in FIG. 4A is corrected when it is determined that there is an abnormality in either one of the first metering valve 6 and the second metering valve 8. Accordingly, the storage capacity of the ECU 20 can be reduced compared to the case where the separate map is prepared.

The above-described embodiments may be modified as follows.

The controller according to the second embodiment performs the processing for smoothing the change of the base angle AB. Alternatively, processing for smoothing the change of the pressure-feeding start angle (AB+FB) may be performed.

The processing for smoothing the base angle AB or the pressure-feeding start angle (AB+FB) is not limited to the above-described processing. Alternatively, filtering processing such as moving average processing may be used.

The number of the plungers of the fuel pump 4 is not limited to two as long as the fuel pump 4 has multiple plungers. For example, if the controller according to the first embodiment is modified such that the fuel pump 4 has three plungers, a map for the case where one out of the three pressure-feeding systems is abnormal and a map for the case where two out of the three pressure-feeding systems are abnormal may be prepared.

The number of the plungers of the fuel pump 4 may not be equal to the number of the metering valves. For example, a situation similar to the situation occurring when the abnormality is caused in either one of the metering valves according to the above-described embodiments can occur also when two plungers commonly using a single metering valve are used and either one of the plungers sticks to an inner wall of the fuel pump 4 and the like to cause an abnormality to stop the reciprocating motion of the plunger. Even in this case, deciding the pressure-feeding start angle assumed to be able to conform the fuel pressure to the target fuel pressure with the single plunger through the feedforward control is effective.

The metering valve is not limited to the discharge metering valve. Alternatively, a suction metering valve for regulating the discharge amount of the fuel pump by regulating a fuel amount suctioned into the fuel pump may be employed. If the suction metering valve regulates the fuel amount with binary motion of opening operation and closing operation, end timing of the suction (suction end angle) may be operated. The discharge metering valve or the suction metering valve is not limited to the valve that regulates the fuel amount by the binary motion of the opening operation and the closing operation. Alternatively, a valve capable of continuously operating an opening degree of a valve member may be used.

The control mode of the fuel pressure is not limited to the mode according to the above-described embodiments that employs the opening-closing timing of the valve member of the metering valve as the direct operation object. For example, a control mode for setting the command discharge amount applied to the fuel pump 4 through feedforward control and feedback control and for converting the command discharge amount into timing for applying the operation signal to the fuel pump 4 or into magnitude of the signal may be employed.

Figure 10:
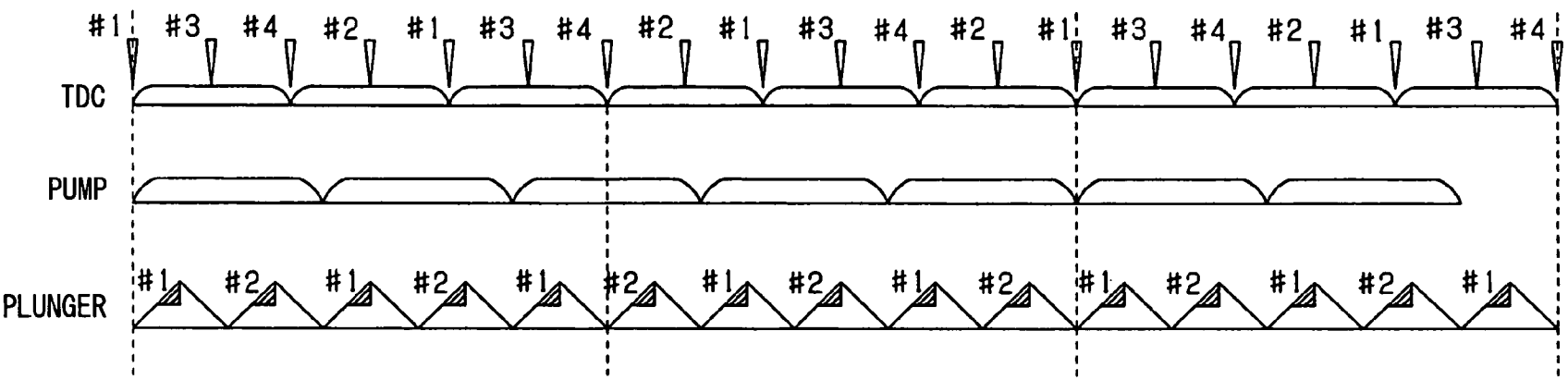
FIG. 10 is a time chart showing an operation of a modified example of the first or second embodiment.

In the above-described embodiments, the present invention is applied to the synchronous system providing the one-to-one correspondence between the fuel injection and the fuel pressure-feeding. Alternatively, the present invention may be applied to an asynchronous system that does not provide the one-to-one correspondence between the fuel injection and the pressure-feeding. FIG. 10 shows an example of the asynchronous system of the four-cylinder diesel engine having the injection cycle of 180° CA and the discharge cycle of 108° CA. In FIG. 10, PUMP represents the rotation of the fuel pump 4 and PLUNGER shows operations of the first and second plungers. In this case, the same relationship between the injection timing of each cylinder and the pressure-feeding timing occurs at every 540° CA. Therefore, effects similar to those of the first embodiment can be exerted by preparing a normal period map and an abnormal period map for deciding the relationship between the operation amount of the fuel pump and the operation state of the diesel engine for each one of the five fuel pressure-feeding operations in the cycle of 540° CA.

The internal combustion engine is not limited to the diesel engine, but may be a direct injection gasoline engine, for example.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A fuel injection controller applied to a fuel injection device of an internal combustion engine having a pressure accumulation chamber that accumulates fuel in a high-pressure state and that supplies the fuel to injectors, a fuel pump that has multiple plunges constituting pressure-feeding systems respectively and that pressure-feeds the fuel to the pressure accumulation chamber through reciprocating motion of the plungers, and a sensor that senses the fuel pressure in the pressure accumulation chamber, the fuel injection controller comprising:

a control device that controls the sensed fuel pressure to target fuel pressure by operating the fuel pump; and an increasing device that increases a pressure-feeding amount of a part of the pressure-feeding systems that does not correspond to an abnormality by compulsorily changing an operation amount of the fuel pump, which is decided by the control device, based on information about the abnormality in the other part of the pressure-feeding systems.

2. The fuel injection controller as in claim 1, wherein the control device has a basic map for deciding a relationship between the operation amount of the fuel pump and an operation state of the engine at the time when the pressure-feeding systems are normal, and the control device operates the fuel pump with the operation amount decided based on the basic map.

3. The fuel injection controller as in claim 2, wherein the increasing device has an abnormal period map for deciding a relationship between the operation amount of the fuel pump required to control the sensed fuel pressure to the target fuel pressure with only a part of the pressure-feeding systems and the operation state of the engine, and the increasing device makes the control device use the abnormal period map instead of the basic map when the controller determines that there is the abnormality.

4. The fuel injection controller as in claim 3, wherein the control device has a function of performing feedback control for conforming the sensed fuel pressure to the target fuel pressure.

5. The fuel injection controller as in claim 4, further comprising:

a smoothing device that smoothes a change of the operation amount due to the compulsory change when the increasing device performs the compulsory change.

6. The fuel injection controller as in claim 2, wherein the increasing device has a correcting device that corrects the operation amount decided based on the basic map, and the increasing device makes the control device use the operation amount corrected by the correcting device when the controller determines that there is the abnormality.

7. The fuel injection controller as in claim 6, wherein the control device has a function of performing feedback control for conforming the sensed fuel pressure to the target fuel pressure.

8. The fuel injection controller as in claim 1, wherein the fuel pump has multiple metering valves corresponding to the plungers, and the increasing device employs existence or nonexistence of an abnormality in the metering valves as existence or nonexistence of the abnormality in the pressure-feeding systems.

* * * * *